US007121028B2

(12) United States Patent
Shoen et al.

(10) Patent No.: US 7,121,028 B2
(45) Date of Patent: Oct. 17, 2006

(54) METHOD AND APPARATUS FOR CONVERTING A REARVIEW MIRROR INTO A DEDICATED INFORMATION DISPLAY

(75) Inventors: Mark V. Shoen, Phoenix, AZ (US); Robert A. Dolan, Gilbert, AZ (US); Rodger A. Ueland, Chandler, AZ (US)

(73) Assignee: U-Haul International, Inc., Phoenix, AZ (US)

( * ) Notice: Subject to any disclaimer, the term of this patent is extended or adjusted under 35 U.S.C. 154(b) by 0 days.

(21) Appl. No.: 10/315,553

(22) Filed: Dec. 9, 2002

(65) Prior Publication Data

US 2004/0107617 A1 Jun. 10, 2004

(51) Int. Cl.
*G09F 21/04* (2006.01)

(52) U.S. Cl. ..... 40/593; 40/591; 359/839

(58) Field of Classification Search ..... 40/593, 40/591; 156/247; 340/461, 815.43, 815.53; 359/838, 839; 362/494, 487; 428/35.7, 428/219, 220

See application file for complete search history.

(56) References Cited

U.S. PATENT DOCUMENTS

| | | | | |
|---|---|---|---|---|
| 1,849,708 | A | 3/1932 | Colbert et al. | 434/408 |
| 4,109,235 | A | 8/1978 | Bouthors | 340/52 F |
| 4,587,158 | A * | 5/1986 | Ewing | 428/219 |
| 4,588,267 | A | 5/1986 | Pastore | 350/600 |
| 4,630,904 | A | 12/1986 | Pastore | 350/600 |
| 4,882,565 | A | 11/1989 | Gallmeyer | 340/461 |
| 5,037,182 | A | 8/1991 | Groves et al. | 359/630 |
| 5,133,141 | A * | 7/1992 | Bane | 40/593 |
| 5,207,492 | A | 5/1993 | Roberts | 362/30 |
| 5,246,519 | A * | 9/1993 | McCormick | 40/593 |
| 5,253,109 | A | 10/1993 | O'Farrell et al. | 359/604 |
| 5,285,060 | A | 2/1994 | Larson et al. | 350/214 AL |
| 5,302,431 | A * | 4/1994 | Schultz | 428/35.7 |
| 5,355,284 | A | 10/1994 | Roberts | 362/30 |
| 5,406,414 | A | 4/1995 | O'Farrell et al. | 359/604 |
| 5,408,357 | A | 4/1995 | Beukema | 359/493 |
| 5,416,313 | A | 5/1995 | Larson et al. | 250/214 AL |
| 5,481,409 | A | 1/1996 | Roberts | 359/839 |
| 5,530,240 | A | 6/1996 | Larson et al. | 250/214 AL |
| 5,566,224 | A | 10/1996 | Ul Azam et al. | 379/58 |
| 5,670,935 | A | 9/1997 | Schofield et al. | 340/461 |
| 5,682,267 | A | 10/1997 | Tonar et al. | 359/603 |
| 5,689,370 | A | 11/1997 | Tonar et al. | 359/603 |
| 5,825,527 | A | 10/1998 | Forgette et al. | 359/267 |
| 5,878,353 | A | 3/1999 | Ul Azam et al. | 455/550 |
| 5,883,605 | A | 3/1999 | Knapp | 345/7 |
| 5,949,331 | A | 9/1999 | Schofield et al. | 340/461 |
| 6,106,121 | A | 8/2000 | Buckley et al. | 359/839 |
| 6,111,683 | A | 8/2000 | Cammenga et al. | 359/267 |
| 6,170,956 | B1 | 1/2001 | Rumsey et al. | 359/839 |

(Continued)

*Primary Examiner*—Lars A. Olson
(74) *Attorney, Agent, or Firm*—Richard E. Oney; Tiffany & Bosco, P.A.; Jeffer, Mangels, Butler & Marmaro LLP

(57) ABSTRACT

A dedicated information display in a vehicle is provided, the display having a rearview mirror with a reflective surface. The display also includes a label having an adhesive side and a display side, and a size and a shape that covers a portion of the reflective surface of the rearview mirror. The adhesive side of the label is affixed to the rearview mirror such that the rearview mirror is converted into an effectively dedicated information display. The information display may also be constructed using an electronic display.

16 Claims, 4 Drawing Sheets

U.S. PATENT DOCUMENTS

| | | | | |
|---|---|---|---|---|
| 6,172,613 | B1 | 1/2001 | DeLine et al. | 340/815.4 |
| 6,181,242 | B1 | 1/2001 | Nguyen | 340/461 |
| 6,200,010 | B1 | 3/2001 | Anders | 362/511 |
| 6,218,934 | B1 | 4/2001 | Regan | 340/438 |
| 6,222,447 | B1 | 4/2001 | Schofield et al. | 340/461 |
| 6,247,820 | B1 | 6/2001 | Van Order | 359/604 |
| 6,291,906 | B1 | 9/2001 | Marcus et al. | 307/10.1 |
| 6,329,925 | B1 | 12/2001 | Skiver et al. | 340/815.4 |
| 6,366,213 | B1 | 4/2002 | DeLine et al. | 340/815.4 |
| 6,520,667 | B1 * | 2/2003 | Mousseau | 362/494 |
| 6,572,233 | B1 * | 6/2003 | Northman et al. | 359/839 |
| 2001/0003439 | A1 | 6/2001 | DeLine et al. | 340/815.4 |
| 2001/0055165 | A1 | 12/2001 | McCarthy et al. | 359/839 |
| 2002/0005999 | A1 | 1/2002 | Hutzel et al. | 359/838 |
| 2002/0017985 | A1 | 2/2002 | Schofield et al. | 340/436 |
| 2002/0039238 | A1 | 4/2002 | Chang | 359/604 |

* cited by examiner

METHOD AND APPARATUS FOR CONVERTING A REARVIEW MIRROR INTO A DEDICATED INFORMATION DISPLAY

FIELD OF THE INVENTION

The present invention relates generally to information display devices in vehicles, and more particularly, to a method and apparatus for converting a rearview mirror of a vehicle into a dedicated information display.

BACKGROUND OF THE INVENTION

In the moving equipment rental business, vehicles such as trucks or large vans are often rented to customers who do not have familiarity with the characteristics of these types of vehicles. For example, trucks typically have a height that is much higher than regular passenger vehicles. Thus, trucks have a higher clearance requirement for overpasses, bridges and entrances to enclosed structures. In addition, as trucks are inherently heavier and are mostly driven under load, they respond differently to various maneuvers such as lane changes and turns. Also, due to the unique design of the vehicles, certain features such as rearview mirrors need to be replaced by such items as additional or larger side-view mirrors.

Not only are the physical characteristics of the trucks or vans different, their maintenance and operational requirements are also different. For example, many trucks require a different type of fuel for proper operation—e.g., diesel versus unleaded gasoline. In addition, many trucks have manual transmissions and require the operator to understand the shifting patterns for the vehicle.

The consequences for the renter or operator of the vehicle who is not made aware of the above-mentioned requirements are potentially disastrous. The vehicle may be damaged from the operator trying to pass under a structure that is not high enough for the vehicle, the engine could be damaged or be subject to undue wear and tear due the use of the wrong type of fuel, or the operator or other persons could suffer serious injury where the operator is unaware of the maneuvering characteristics of the vehicle.

In an attempt to provide the renter or operator of the vehicle some warnings or other information important to the operation and maintenance of the vehicle, a brochure or other loose leaf paper is typically handed to the customer or placed in the vehicle at the time of rental. However, due to the amount of paperwork that is handed to the operator at the time of rental—including invoices, receipts, maps and other miscellaneous paperwork, the operator sometimes may not review the provided instructions. In other cases, the operator does not review important information because either the operator misplaces the information; or, where the operator is not the renter, the operator is not provided the information by the renter.

In the alternative, if the information is not given to the renter or operator but, instead, is placed in the vehicle at the time of rental, an additional challenge would be to place the information in a location that is optimal for the operator to notice while preventing clutter in the interior of the vehicle. Space is not usually available on the dashboard as instrumentation and controls are optimally located in front of the driver. But if the information is placed somewhere else, such as on the door, the operator might miss it. Accordingly, there is a need for providing a dedicated information display that will supply important information to the operator. And further, place the information such that notice is more fully assured.

SUMMARY OF THE PREFERRED EMBODIMENTS

The present invention provides a dedicated information display by mounting an informational label on a rearview mirror, thereby converting the primary utility of the rearview mirror from a reflective surface to an information display.

It is an object of the present invention to provide a method of converting a vehicle rearview mirror into a dedicated information display. The method having the steps of obtaining an label containing information, the label being sized and shaped to cover at least a portion of the rearview mirror, and affixing the label to the rearview mirror.

It is also an object of the present invention to provide a dedicated information display in a vehicle. The dedicated information display including a rearview mirror and a label having an adhesive side and a display side. The size and shape of the label is configured to cover a portion of the reflective portion of the rearview mirror. The adhesive side of the label is affixed to the rearview mirror, whereby the rearview mirror is converted into an effectively dedicated information display.

It is yet another object of the present invention to provide a dedicated information display in a vehicle with interchangeable displays. The dedicated information display includes a rearview mirror with a reflective surface, and a label holder having an attachment means for affixing the label holder to the rearview mirror. The label holder also includes a bezel for enclosing a label, with the bezel having an opening to display the label. When the label holder is affixed to the rearview mirror, the rearview mirror is converted into an effectively dedicated information display.

It is still yet another object of the present invention to provide a display in a vehicle with a rearview mirror, where the display includes an electronic display device having an attachment means for affixing the informational display device to the vehicle; and, a size and a shape that covers at least a portion of the rearview mirror. When the electronic display device is affixed to the vehicle, the portion of the rearview mirror that is covered by the informational display device is inoperable as a reflective surface.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE INVENTION

The present invention takes advantage of the presence of a rearview mirror in a strategic position in all vehicles and, in one embodiment, converts the rearview mirror into a dedicated information display device by using a label or decal that is affixed to the rearview mirror. The use of a label or decal allows the creation of dedicated information display at an extremely low cost as almost all vehicles contain a rearview mirror. In addition, no safety is sacrificed by eliminating the rearview mirror as a reflective device in most trucks because most trucks are built with a utility box that obscures the view behind the cab of the truck. Thus, the operator would normally use the side-view mirrors anyway. More importantly, the use of the rearview mirror provides a conditioned focal point for the operator as it is one of the places in the vehicle that all operators check before operating the vehicle and also during use.

Figure 1:
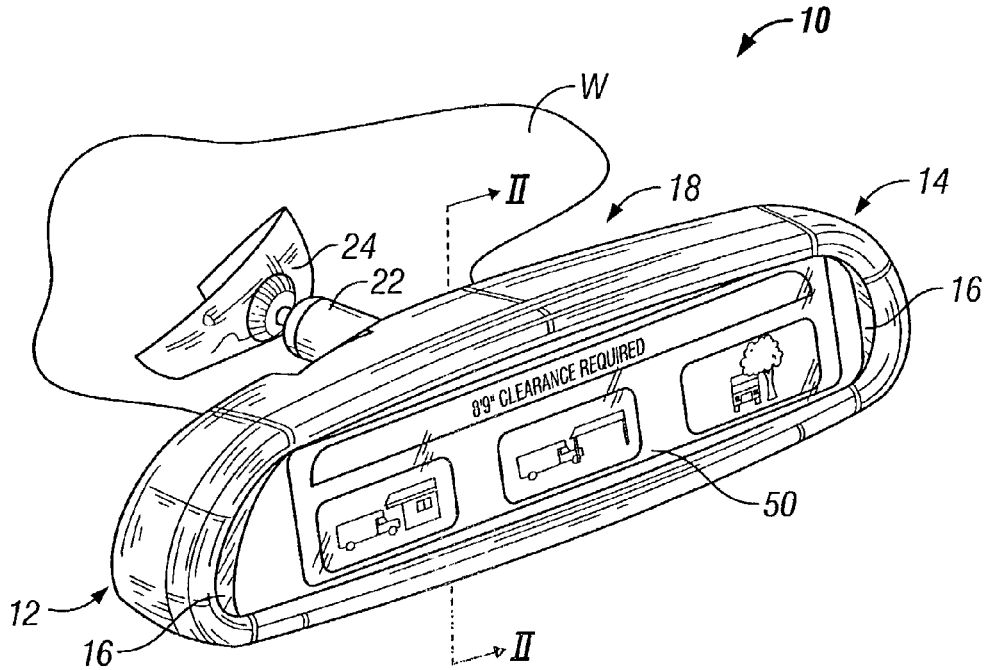
FIG. 1 is a perspective view of an information display device configured in accordance to a preferred embodiment of the present invention.

FIG. 1 is a perspective view of an information display device 10 configured in accordance with one embodiment of the present invention. Information display device 10 includes a rearview mirror assembly 12 attached to a front windshield W using a support arm 22 and a windshield attachment 24. The rearview mirror assembly 12 includes a housing 18 in which a mirror 16 is contained. Mirror 16 is visible through housing 18 through the opening defined by a bezel 14. Affixed to mirror 16 is an informational label 50.

As shown in FIG. 1, where the vehicle is a truck, informational label 50 includes information that helps an operator avoid the damaging of the utility box portion of the truck by providing such information as the height clearance needed by the truck, including the utility box; and obstacles of which the operator should be aware that may cause clearance problems. The information that may be provided by informational label 50 is not limited by the exemplary images shown in FIG. 1. Other information that may be provided includes warning information as to the handling and maneuvering characteristics of the vehicle, the type of fuel that is required by the vehicle, instructions and contact information in case of emergencies (e.g., an accident), proper tire pressure levels, and suggestions for safe operation of the vehicle. Still another use for informational label 50 may be to display marketing or promotional information.

Figure 2:
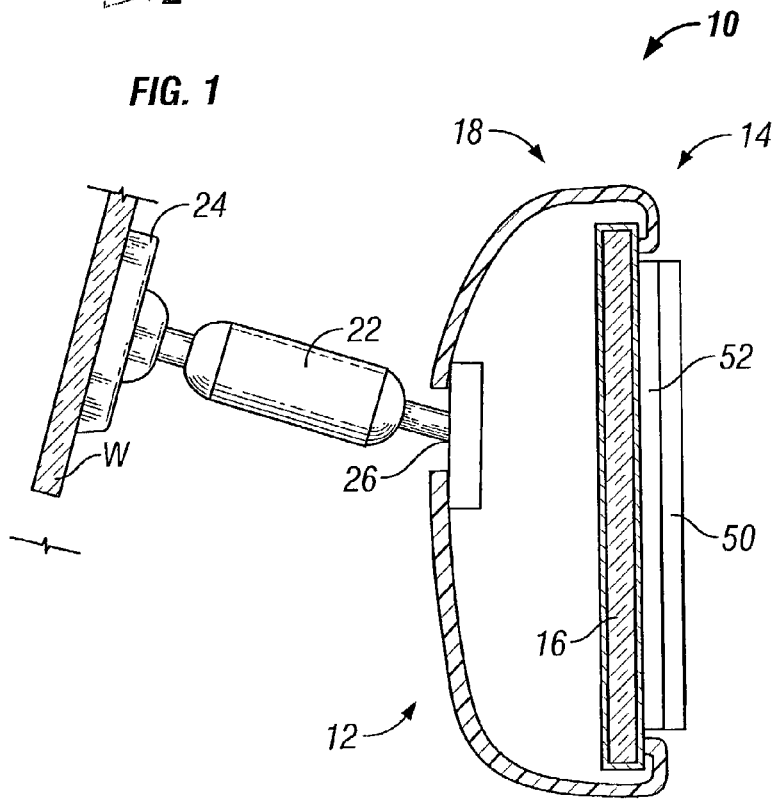
FIG. 2 is a cross-section view of the information display device of FIG. 1 taken along line II—II.

FIG. 2 is a cross-section view of information display device 10 along line II—II of FIG. 1, where it is shown that rearview mirror assembly 12 is attached to support arm 22 through a pivot joint 26. Pivot joint 26 allows the operator to position review mirror assembly 12, and therefor informational label 50, to the most advantageous position for viewing by the operator.

FIG. 2 also shows the layer structure of information display device 10, including informational label 50 attached to mirror 16 through the use of an adhesive 52. Adhesive 52 may be one solid piece of adhesive, or it may be composed of several strips of adhesives. Any type of adhesive may be used, as long as it provides a secure bond between informational label 50 and mirror 16. Also, adhesive 52 is an adhesive that is heat tolerant, such that during a hot day and if the cab of the truck is fully enclosed, the adhesive will not melt or otherwise breakdown. Conversely, adhesive 52 is also cold tolerant, such that during a cold day, the adhesive will not become brittle or otherwise breakdown. In one embodiment, adhesive is pre-deposited on one surface of informational label 50. In another embodiment, informational label 50 may be attached to mirror 16 through a manually applied adhesive. Also, informational label 50 may be mounted to rearview mirror assembly 12 using an adhesive to some part of housing 18, such as bezel 14.

As shown in FIG. 1 and FIG. 2, informational label 50 covers substantially all of the area of mirror 16 accessible through the opening defined by bezel 14. This provides a full surface area on which to display the greatest amount of information possible. In another embodiment, informational label 50 may cover not only the part of mirror 16 that is accessible through the opening defined by bezel 14, but is also large enough to cover a part of bezel 14. This allows mounting of informational label 50 to housing 18. In yet another embodiment, informational label 50 is sized to cover only a portion of mirror 16.

Figure 3:
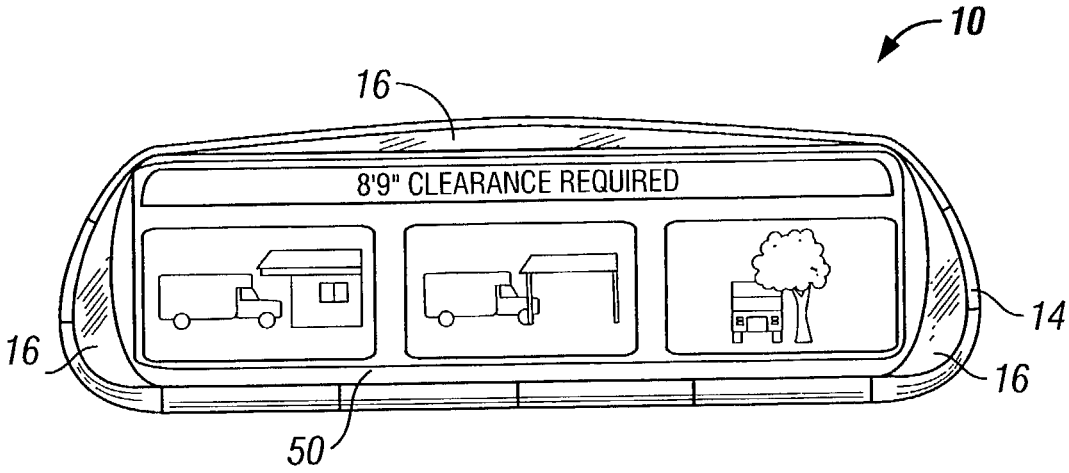
FIG. 3 is a front elevation view of the information display device of FIG. 1.

FIG. 3 illustrates a front elevation view of information display device 10, where insubstantial portions of mirror 16 may be seen through the openings between informational label 50 and bezel 14 of housing 18. What parts of mirror 16 may be covered by display device 10 is not usable as a reflective surface for almost any purpose, and most definitely not usable for driving purposes. In one embodiment, a substantial portion of mirror 16, which is at least 30% of the mirror, is covered by informational label 50, thus leaving 70% or less of mirror 16 to function as a reflective surface. In a more preferred embodiment, at least 50% of mirror 16 is covered by informational label 50. In an even more preferred embodiment, at least 75% of mirror 16 is covered by informational label 50. In a still even more preferred embodiment, at least 90% mirror 16 is covered by informational label 50. In the most preferred embodiment, mirror 16 is completely covered by informational label 50, leaving rearview mirror assembly 12 usable only as an informational display, with no remaining portion being usable as a reflective surface for the operation of the vehicle. As discussed herein, the loss of functionality of mirror 16 as a reflective surface has no impact on the operation of the vehicle where the vehicle is a truck that has an utility box or other structure that blocks the line of sight directly behind the cab.

Figure 4:
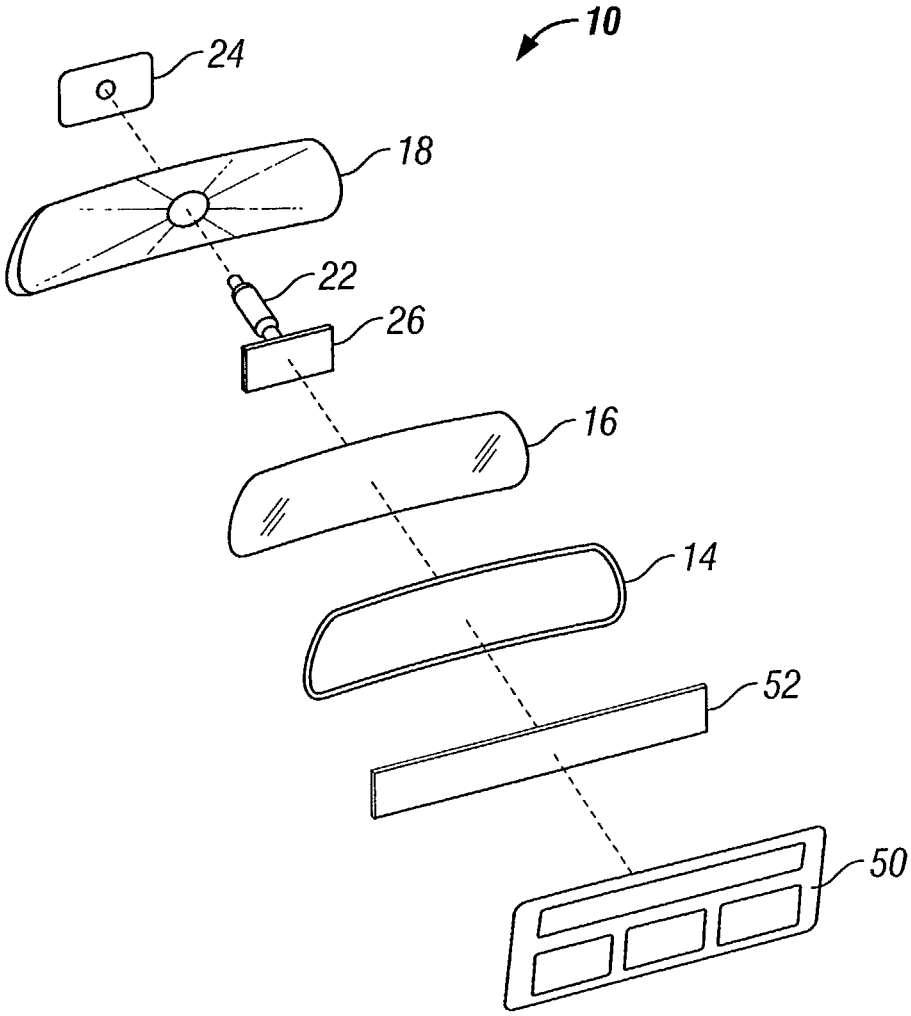
FIG. 4 is an exploded view of the information display device of FIG. 1.

FIG. 4 is an exploded view of informational display device 10 providing another illustration of the layers of mirror 16, adhesive 52 and informational label 50. The assembly of information display device 10 may also be seen in this figure.

Figure 5:
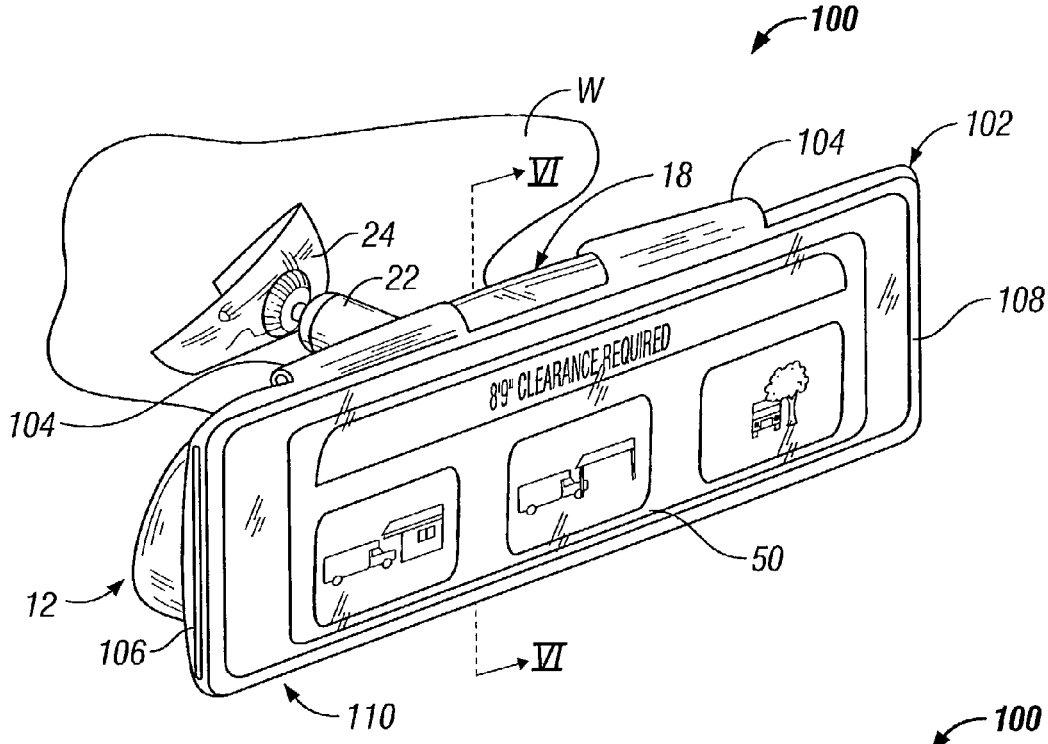
FIG. 5 is a perspective view of another information display device configured in accordance to a second embodiment of the present invention.

FIG. 5 is a perspective view of an informational display device 100 configured in accordance with another embodiment of the present invention. In this embodiment, rearview mirror assembly 12 is used as part of informational display device 100. Thus, like numerals refer to like parts throughout the drawings. Information display device 100 includes a informational label holder 110 secured to housing 18 of review mirror assembly 12. Informational label holder 110 includes a housing 102, a bezel 108, and a slot 106. Informational label 50 is inserted into informational label holder 110 through slot 106 and visible through the opening defined by bezel 108. As discussed below, informational label 50 is also held in place by bezel 108. Use of informational label holder 110 instead of directly affixing informational label 50 directly to mirror 16 provides interchangeability of different types of informational labels. For example, if there is an update to the information that is being provided to the operator, a new informational label may be used instead of informational label 50. The information that may be updated includes operational characteristics of the vehicle, marketing information, or other appropriate information to be conveyed to the operator. Thus, informational display device 100 may be altered with minimal cost and effort.

Figure 6:
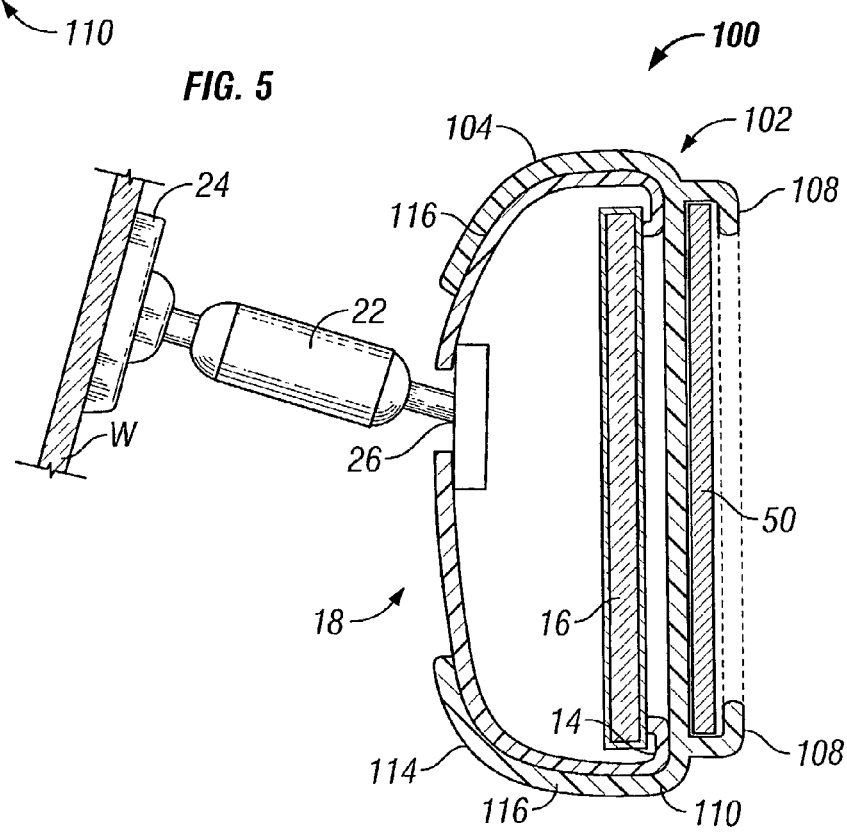
FIG. 6 is a cross-section view of the information display device of FIG. 5 taken along line VI—VI.

Informational label holder 110 is secured to housing 18 through the use of a set of upper arms 104 and a set of bottom arms 114 (shown in FIG. 6). In another embodiment, informational label holder 110 may use detachable fastening means such as suction cups that attaches to mirror 16. In yet another embodiment, hook-and-loop type fasteners may be used, either by wrapping around housing 18 or by adhering a set of loop-side patches to housing 18 and coupling a corresponding set of hook-side strip from informational label holder 110 to the set of loop-side patches. In still yet another alternative, informational label holder 110 may be secured to housing 18 through the use of a set of clips or flexible arms that mechanically holds informational label holder 110 to housing 18. In yet a further embodiment, informational label holder 110 may be affixed to mirror 16, instead of housing 18, through the use of adhesives. Through various fastening means, informational label holder 110 can either be permanently or temporarily attached to rearview mirror assembly 12.

FIG. 6 is a cross-section view of information display device 100 along line VI—VI of FIG. 5, where the layer structure of information display device 100 is shown, including informational label holder 110 attached to housing 18 through the use of a set of adhesives 116 between set of upper arms 104 and housing 18, and a set of adhesives 116 between set of lower arms 114 and housing 18. Any type of adhesive may be used, as long as it provides a secure bond between informational label holder 110 and housing 18. In one embodiment, adhesive is pre-deposited on set of upper arms 104 and set of lower arms 114. In another embodiment, set of upper arms 104 and set of lower arms 114 may be attached to housing 18 through a manually applied adhesive.

Referring still to FIG. 6, informational label 50 is enclosed in housing 102 and visible to the operator through the opening in bezel 108. Informational label 50 rests in the channel formed by bezel 108 and housing 102.

Figure 7:
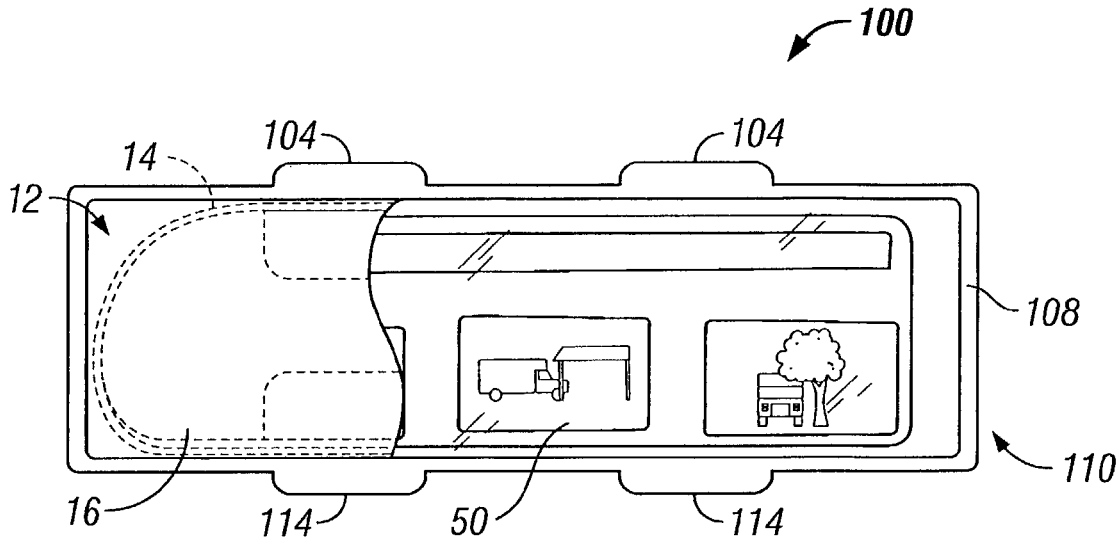
FIG. 7 is a front elevation view of the information display device of FIG. 5.

FIG. 7 illustrates a front elevation view of information display device 100. In one embodiment, a substantial portion of mirror 16, which is at least 30% of the mirror, is covered by informational label holder 110, thus leaving 70% or less of mirror 16 to function as a reflective surface. In a more preferred embodiment, at least 50% of mirror 16 is covered by informational label holder 110. In an even more preferred embodiment, at least 75% of mirror 16 is covered by informational label holder 110. In a still even more preferred embodiment, at least 90% mirror 16 is covered by informational label holder 110. In the most preferred embodiment, mirror 16 is completely covered by informational label holder 110, leaving rearview mirror assembly 12 usable only as an informational display, with no remaining portion being usable as a reflective surface for the operation of the vehicle. FIG. 7 illustrates the embodiment where informational label 50 is visible through bezel 108 of informational label holder 110 but mirror 16 is completely covered. Thus, rearview mirror assembly 12 is unusable as a reflective surface for any purpose, including for driving purposes. As discussed herein, the loss of functionality of mirror 16 as a reflective surface has no impact on the operation of the vehicle where the vehicle is a truck that has an utility box or other structure that blocks the line of sight directly behind the cab. In another embodiment, as stated above, where informational label holder 110 only covers a portion of mirror 16, only the portion that is covered is unusable as a reflective surface.

Figure 8:
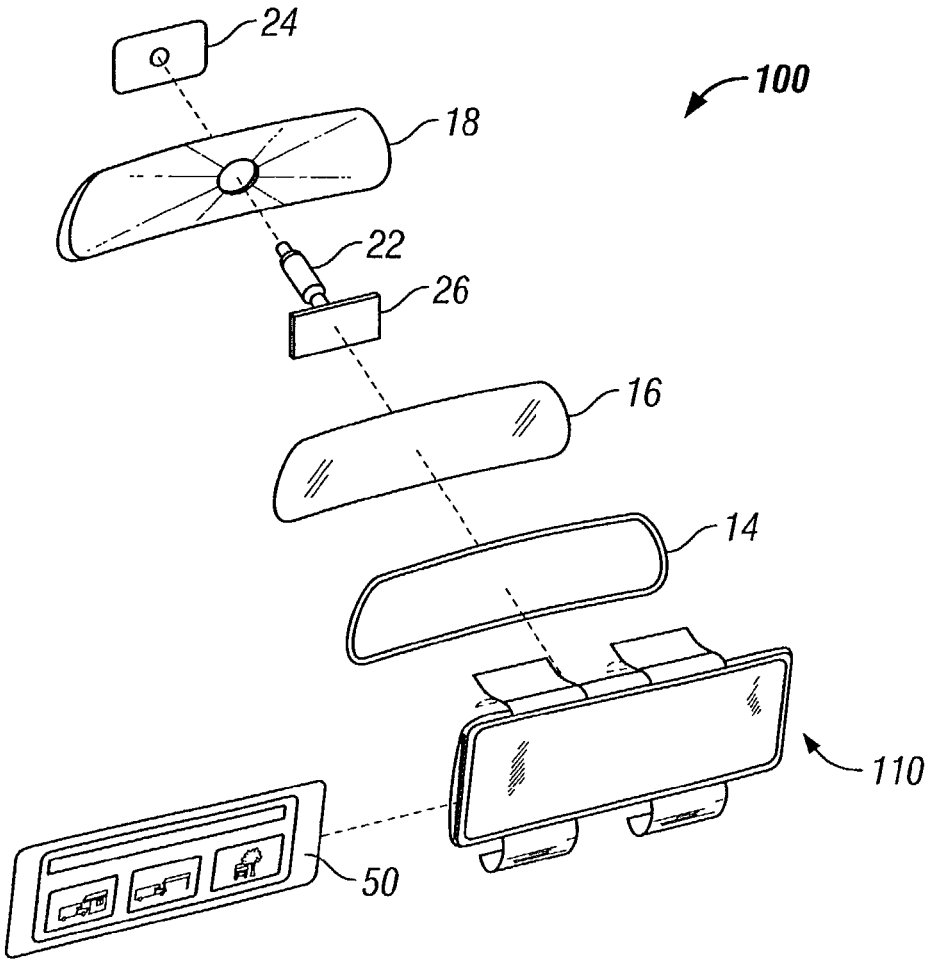
FIG. 8 is an exploded view of the information display device of FIG. 5.

FIG. 8 is an exploded view of informational display device 100 providing another illustration of the layers made up of rearview mirror assembly 12, informational label holder 110 and informational label 50, before it is inserted into informational label holder 110. The parts of rearview mirror assembly 12 may also be seen in this figure.

It should be noted that other means for creating informational displays devices using rearview mirror assembly 12 are equally useful and falls under the inventive concepts considered herein. Further, it might be desirable in some applications to replace rearview mirror assembly 12 with a different assembly, perhaps still using support arm 22, windshield attachment 24, or pivot joint 26 to attach the new assembly. Further still, the assembly may be mounted to the vehicle using other attachment points such as to windshield W directly, the ceiling of the cab, or some other mounting point that does not depend on rearview mirror assembly 12.

For example, instead of a fixed display such as informational label 50, an electronic display may be used. The electronic display may be constructed using any variety of display devices like liquid crystal displays (LCD), field emission displays, and light emitting diode displays. Further, the display would be coupled to a computing device that would provide processing and storage functions for the information to be displayed. The computing device may contain updatable storage such that the programming of the computing device may be changed so that the electronic display may offer different functionality, or the information to be displayed may be changed. The electronic display may be configured to update using removable data storage devices (compact flash cards, electronically erasable and programmable memory, magnetic media, compact discs, and the like), or through a wired (Ethernet, parallel, serial, and the like) or wireless (radio frequency, infrared, and the like) network.

Using a computing device instead of a static display allows the electronic display to be dynamically changed based on a variety of conditions without user intervention, such as displaying warnings for low-hanging structures that may damage the vehicle, in addition to such environmental information as current weather, traffic conditions and time. Other examples include updating vehicle information such as vehicle speed or condition, marketing information depending on the season, or customized information based on information the system knows about the operator.

The embodiments described above are exemplary embodiments of a dedicated information display. Those skilled in the art may now make numerous uses of, and departures from, the above-described embodiments without departing from the inventive concepts disclosed herein. Accordingly, the present invention is to be defined solely by the scope of the following claims.

What is claimed is:

1. A dedicated information display in a vehicle with a rearview mirror, the rearview mirror having a reflective surface, comprising:

a label holder having:

an attachment means for affixing the label holder to the rearview mirror;

a bezel for enclosing a label, the bezel including an opening to display the label;

whereby when the label holder is affixed to the rearview mirror, the rearview mirror is converted into an effectively dedicated information display.

2. The display of claim 1, where the attachment means comprises a set of mounting arms with each arm having an adhesive pad.

3. The display of claim 2, where the adhesive pad comprises an adhesive that is a heat tolerant adhesive.

4. The display of claim 2, where the adhesive pad comprises an adhesive that is a cold tolerant adhesive.

5. The display of claim 1, where the attachment means comprises a set of hook-and-loop type fasteners.

6. The display of claim 1, where the attachment means comprises a set of suction cups.

7. The display of claim 1, where the label holder is removably affixed to the rearview mirror.

8. The display of claim 1, where the label holder includes an opening on an edge of the label holder through which the label is inserted.

9. A display in a vehicle with a rearview mirror comprising:

an informational display device having:

an attachment member for affixing the informational display device to the rearview mirror; and, a size and a shape that covers at least a portion of the rearview mirror, and the portion of the rearview mirror being covered is prevented from acting as a mirror surface;

whereby when the informational display device is affixed to the rearview mirror, the rearview mirror is converted into an informational display.

10. The display of claim 9, where the rearview mirror has a reflective surface and the size and the shape of the informational display device covers a substantial portion of the reflective surface of the rearview mirror.

11. The display of claim 9, where the attachment member comprises a set of mounting arms with each arm having an adhesive pad.

12. The display of claim 11, where the adhesive pad comprises an adhesive that is a heat tolerant adhesive.

13. The display of claim 11, where the adhesive pad comprises an adhesive that is a cold tolerant adhesive.

14. The display of claim 9, where the attachment member comprises a set of hook-and-loop type fasteners.

15. The display of claim 9, where the attachment member comprises a set of suction cups.

16. The display of claim 9, where the informational display device is removably affixed to the rearview mirror.

* * * * *